US009624945B2

(12) United States Patent
Guo et al.

(10) Patent No.: US 9,624,945 B2
(45) Date of Patent: Apr. 18, 2017

(54) CIRCULATION PUMP

(71) Applicant: Johnson Electric S.A., Murten (CH)

(72) Inventors: Chuan Jiang Guo, Shenzhen (CN); Chuan Hui Fang, Hong Kong (CN); Feng Xue, Shenzhen (CN)

(73) Assignee: JOHNSON ELECTRIC S.A., Murten (CH)

( * ) Notice: Subject to any disclaimer, the term of this patent is extended or adjusted under 35 U.S.C. 154(b) by 403 days.

(21) Appl. No.: 14/304,755

(22) Filed: Jun. 13, 2014

(65) Prior Publication Data

US 2014/0369824 A1 Dec. 18, 2014

(30) Foreign Application Priority Data

Jun. 13, 2013 (CN) ..... 2013 1 0232708

(51) Int. Cl.

*F04D 29/44* (2006.01)
*F04D 29/02* (2006.01)
*F04D 29/42* (2006.01)

(52) U.S. Cl.

CPC ..... *F04D 29/445* (2013.01); *F04D 29/026* (2013.01); *F04D 29/4273* (2013.01); *F04D 29/4293* (2013.01); *F04D 29/426* (2013.01); *F04D 29/428* (2013.01); *F05D 2230/20* (2013.01); *F05D 2230/53* (2013.01); *F05D 2300/43* (2013.01)

(58) Field of Classification Search

CPC .... F04D 29/426; F04D 29/445; F04D 29/428; F04D 29/026; F04D 29/4273; F04D 29/4293

USPC ..... 415/915

See application file for complete search history.

(56) References Cited

U.S. PATENT DOCUMENTS 3,292,549 A 12/1966 Nicoll
3,829,238 A * 8/1974 Speck ..... F04D 29/026 415/197

(Continued)

FOREIGN PATENT DOCUMENTS

DE 38 13 654 A1 11/1989
DE EP 0733808 A1 * 9/1996 ..... F04D 29/4273

(Continued)

OTHER PUBLICATIONS

Google translation for EP 0733808 A1, EP 0731279 B1, WO 0070229 A1, DE 10103209 A1, EP 1503083 A1, EP 1719916 A1, DE 102006049292 A1, and EP 1950420 A2.*

*Primary Examiner* — John K Fristoe, Jr.
*Assistant Examiner* — Behnoush Haghighian
(74) *Attorney, Agent, or Firm* — Muncy, Geissler, Olds & Lowe, P.C.

(57) ABSTRACT

An electric pump has a pump casing, a sealing plate, an impeller and a motor for driving the impeller. The pump casing has a main body. A recess is formed in the main body and with the sealing plate defines a pump chamber. A suction port is connected to the pump chamber by a suction channel and a suction passage formed in the main body. A discharge port is connected to the pump chamber by a discharge channel. The suction passage extends axially from the recess. The recess, suction passage, suction channel and discharge channel are all shaped in a manner allowing the pump casing can be molded as a monolithic structure in a single injection molding process.

10 Claims, 6 Drawing Sheets

(56) References Cited

U.S. PATENT DOCUMENTS

| | | | | | |
|---|---|---|---|---|---|
| 4,213,742 | A * | 7/1980 | Henshaw | F04D 29/445 | 415/206 |
| 5,046,922 | A * | 9/1991 | Nakamura | C08G 61/08 | 415/172.1 |
| 6,056,506 | A * | 5/2000 | Martin | F04D 29/426 | 415/172.1 |
| 2008/0008578 | A1 | 1/2008 | Dossing | | |
| 2010/0272591 | A1* | 10/2010 | Kjaer | F04D 29/043 | 417/423.3 |
| 2012/0224957 | A1* | 9/2012 | Weber | F04D 29/445 | 415/208.2 |
| 2013/0017077 | A1* | 1/2013 | Hanisch | F04D 29/426 | 415/204 |
| 2013/0287561 | A1* | 10/2013 | Block | F04D 29/426 | 415/208.1 |
| 2015/0001973 | A1* | 1/2015 | Mikkelsen | H02K 5/22 | 310/54 |

FOREIGN PATENT DOCUMENTS

| | | | | | |
|---|---|---|---|---|---|
| DE | EP 0731279 | B1 * | 12/1999 | F04D 29/026 | |
| DE | 199 14 579 | A1 | 11/2000 | | |
| DE | 199 22 234 | A1 | 11/2000 | | |
| DE | WO 0070229 | A1 * | 11/2000 | H02K 5/08 | |
| DE | 10103209 | A1 * | 7/2002 | F04D 29/426 | |
| DE | 102006049292 | A1 * | 4/2008 | F04D 13/06 | |
| DE | EP 1950420 | A2 * | 7/2008 | F04D 29/026 | |
| DK | EP 1719916 | A1 * | 11/2006 | F04B 17/03 | |
| EP | 1 950 420 | A2 | 7/2008 | | |
| EP | 2 072 826 | A1 | 6/2009 | | |
| EP | 2 236 839 | A1 | 10/2010 | | |
| EP | 1079115 | | 4/2013 | | |
| IT | EP 1503083 | A1 * | 2/2005 | F04D 29/026 | |

* cited by examiner

CIRCULATION PUMP

CROSS REFERENCE TO RELATED APPLICATIONS

This non-provisional patent application claims priority under 35 U.S.C. §119(a) from Patent Application No. 201310232708.5 filed in The People's Republic of China on Jun. 13, 2013, the entire contents of which are hereby incorporated by reference.

FIELD OF THE INVENTION

This invention relates to pumps and, particularly, to a pump casing that can be made by a single process of plastic injection molding.

BACKGROUND OF THE INVENTION

An existing plastic pump is shown in FIG. 7, where the motor is not shown. The water inlet pipe 1 of the pump casing includes four sections in serial: starting section 2, first middle section 3, second middle section 4, and end section 5. The starting section 2 is tilted with respect to the axis of the motor. The first middle section 3 is substantially trapezoidal and substantially perpendicular to the axis of the motor, with the opening of smaller diameter connected to the starting section 2. The second middle section 4 bends substantially 90 degrees. The end section 5 is connected to the second middle section 4 and is substantially parallel with the axis of the motor. Water enters the starting section 2, passes through the first and second middle sections 3 and 4, and flows into an impeller 6 via the end section 5.

As the opening of the first middle section 3 having greater diameter is spaced from the starting section 2, a die for producing the first middle section 3 cannot be extracted from the staring section 2. That is to say, the starting section 2 and first middle section 3 cannot be made integrally in a single injection process. Similarly, as the second middle end 5 bends through a large angle, the first middle section 3 and the second middle section 4 cannot be made integrally in a single injection process. Thus, the whole pump casing cannot be made as a single piece plastic injection molding.

SUMMARY OF THE INVENTION

Hence there is a desire for a pump having a casing which is simple to manufacture.

Accordingly, in one aspect thereof, the present invention provides a pump comprising: a pump casing; a pump chamber formed in the pump casing; an impeller disposed within the pump chamber, the impeller having a plurality of vanes forming an inlet and an outlet; a sealing plate, forming one side of the pump chamber; a motor for driving the impeller; wherein the pump casing is a monolithic object comprising: a main body having a first surface, a recess in the first surface, a suction port, a suction channel, a suction passage, a discharge port, and a discharge channel; the recess forms a first opening in the first surface, the first opening is closed by the sealing pump to form the pump chamber, the recess having a second opening in a second surface opposite the first surface and a wall connecting the first surface to the second surface; the suction passage communicates with the recess via the second opening and is aligned with the inlet of the impeller; the suction port is connected to the suction passage by the suction channel; the discharge port is connected to the recess by the discharge channel which extends from a third opening formed in the wall of the recess; the diameter of wall of the recess remains the same or decreases along a direction from the first surface to the second surface; the diameter of the inner surface of the suction passage remains the same or decreases along a direction away from the recess; the inner diameter of the suction channel remains the same or decreases along a direction towards the suction passage; and the inner diameter of the discharge channel remains the same or decreases along a direction towards the recess.

Preferably, the suction channel comprises an inner surface having a top arc wall and a bottom arc wall that is closer to the recess than the top arc wall, the curvature of the top arc wall is between 0.006 and 0.01 $mm^{-1}$, the curvature of the bottom arc wall is between 0.006 and 0.0085 $mm^{-1}$, and an included angle $\alpha$ between the tangent direction of the end of the top arc wall at the suction port and a direction in which the first surface extends and an included angle $\beta$ between the tangent direction of the end of the bottom arc wall at the suction port and a direction in which the first surface extends are both between 5 and 12 degrees.

Curvature is defined as 1/R where R is the radius of the curve measured in millimeters (mm).

Preferably, the curvature of the top arc wall is about 0.0071 $mm^{-1}$; the included angle $\alpha$ is about 5 degrees; the curvature of the bottom arc wall is about 0.0070 $mm^{-1}$, and the included angle $\beta$ is about 8 degrees.

Preferably, the main body further comprises a spiral discharge groove in the boundary of the recess and extending from the second opening to the third opening.

Preferably, the main body further comprises a number of ribs extending from the center to the peripheral thereof.

Preferably, the main body further comprises a first ring projecting into the recess from the second opening, and the impeller further comprises a ring-shaped end surface surrounding the inlet and a second ring projecting from the end surface and surrounding the first ring, the second ring faces the first ring across a radial gap.

Preferably, a radially inner surface of the second ring is inclined at an angle $\theta$, with respect to the axial direction of the impeller.

Preferably, $10° \leq \theta \leq 20°$.

Preferably, the radially inner end of the end surface of the impeller extends closer to the axis of the impeller, compared to the radially inner end of the first ring.

Preferably, the end surface is inclined at an angle $\lambda$ to a radial plane, such that the inner edge of the end surface is displaced towards the suction passage.

Preferably, $5° \leq \lambda \leq 40°$.

Preferably, the pump casing is a single piece plastic injection molding.

In embodiments of the present invention, due to detailed structure of the pump casing as described above, the pump casing that can be made as a single piece by a single plastic injection molding process, simplifying the manufacturing process. In some embodiments, as the second ring is arranged to surround the first ring, water is fully ducted into the impeller. This improves the efficiency of the pump.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
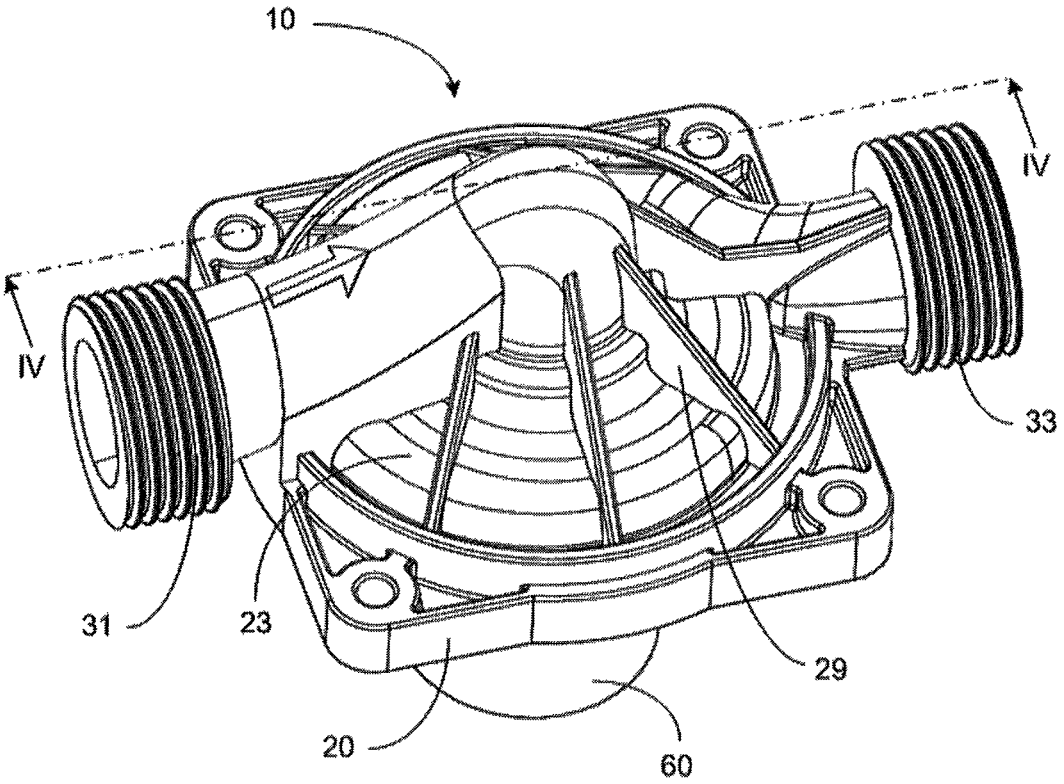
FIG. 1 illustrates a pump in accordance with an embodiment of the present invention.
Figure 2:
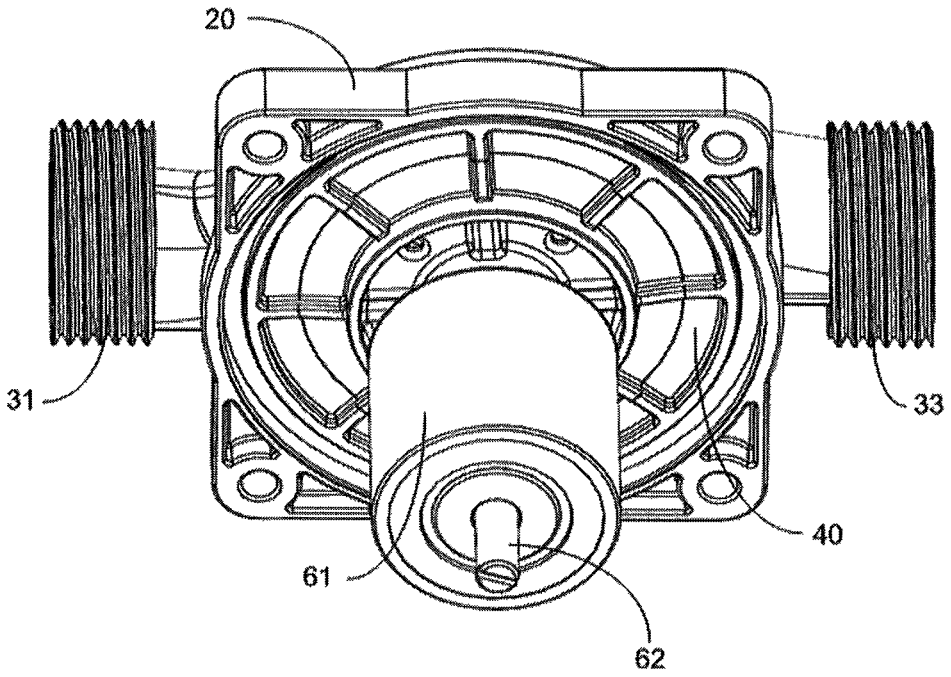
FIG. 2 is a view from below of the pump of FIG. 1.

Referring to FIGS. 1 and 2, according to a preferred embodiment of the present invention, an electric pump 10 includes a pump casing 20 and a sealing plate 40 for sealing an opening of the pump casing 20. An impeller 50 (shown in FIG. 4) is received in a pump chamber defined by the pump casing 20 and the sealing plate 40. An electric motor 60 is connected to the sealing plate 40 and arranged to drive the impeller. In FIG. 2, a part of the motor has been removed to reveal that the motor has a permanent magnet rotor 61.

Figure 3:
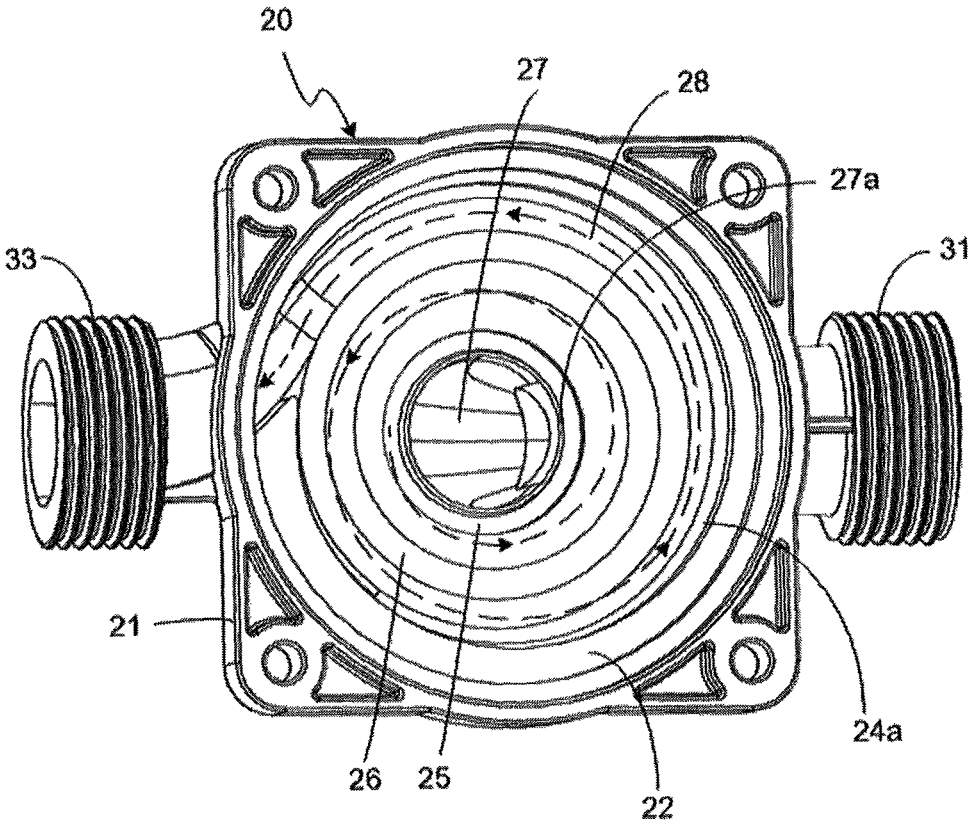
FIG. 3 is a view from below of a pump casing of the pump of FIG. 1.
Figure 4:
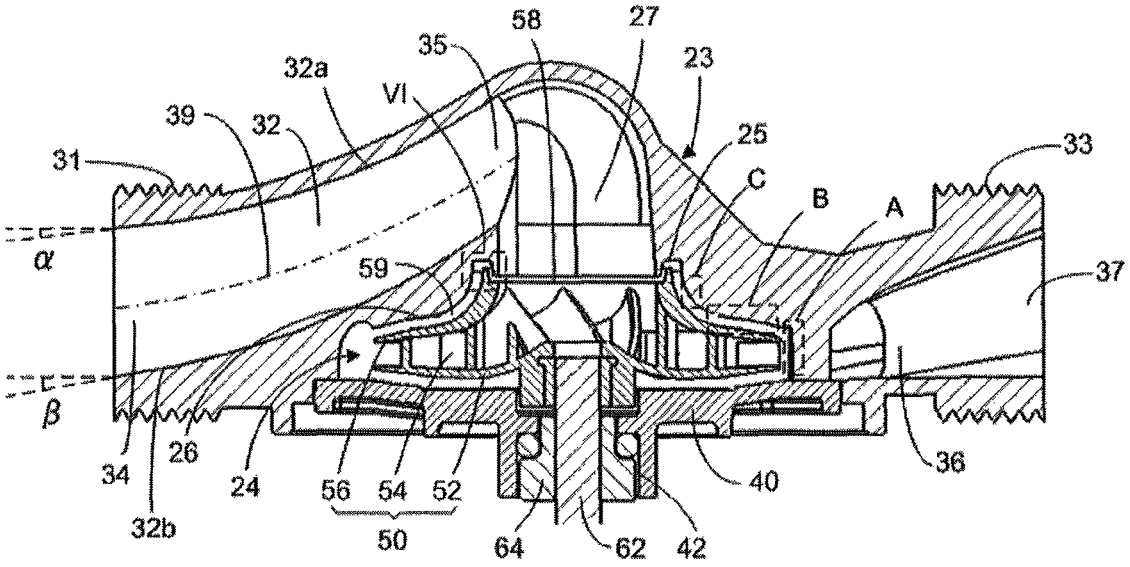
FIG. 4 is a sectional view of part of the pump, taken along the line IV-IV of FIG. 1.

Referring to FIGS. 3 and 4, the pump casing 20 includes a main body 21, a suction port 34, and a discharge port 33. The main body 21 is substantially cone-shaped. A first side surface 22 of the main body 21 is substantially flat and is substantially square in the present embodiment. A second side surface 23, opposing the first side surface 22, is convex. A recess 24 is formed in the first side surface 22, having a cross section in a plane perpendicular to the axis of the motor 60 of circular shape. The recess 24 creates a first opening 24*a* on the first side surface 22 and is bounded by a second surface 25 and a wall 26 connecting the first side surface 22 to the second surface 25. In a direction from the first side surface 22 to the second surface 25, the inner diameter of the recess 24 becomes smaller. A suction passage 27 is formed in the main body 21. The suction passage extends in an axial direction and communicates with the recess via a second opening 27*a* in the second surface 25. In the present embodiment, the cross section of the suction passage 27 is substantially circular and the inner diameter thereof becomes smaller as it moves away from the second surface 25. A discharge groove 28 is formed in the boundary of the recess, substantially in the second surface 25. The discharge groove 28 is spiral, extending from the suction passage 27 to a third opening 36 in the wall of the recess. According to the above description, a die for forming the recess 24 and the suction passage 27 can be removed from the first side surface 22, without damage. It should be understood that in other embodiments, the inner diameter of the suction passage 27 can be constant. This can also fulfill the above purpose.

It should be noted that, in the present embodiment, the inner diameter becoming smaller is not necessarily limited to gradually becoming smaller, it only describes a general trend. For example, referring to FIG. 4, along a direction from the first side surface 22 to the second surface 25, the inner diameter of a portion of the recess 24 can be substantially the same, such as the portion shown in block A, the inner diameter of a portion of the recess 24 can become smaller quickly, such as the portion shown in block B; or the inner diameter of a portion of the recess 24 can gradually become smaller gradually, such as the portion shown in block C. It is designed like this to match the shape of the impeller 50 and the sealing plate 40, while at the same time allowing easy release of the molding die.

An inlet tube 31 is integrally formed with the main body 21 and includes the suction port 34, the suction channel 32 and a suction passage opening 35. The suction passage opening 35 is formed in the side surface of the suction passage 27, allowing the suction channel to communicate or connect with the suction passage 27. The inner diameter of the suction channel becomes smaller as it comes closer to the suction passage 27. The suction channel is arc-shaped in the present embodiment. The discharge channel 37 connects the third opening 36 to the discharge port 33. The discharge channel 37 is integrally formed in the main body 21, opposing the inlet tube 31. The third opening 36 is formed in the wall 26 of the recess 24, allowing the recess 24 to communicate with the discharge port 33. Along a direction from the discharge port to the recess 24, the inner diameter of the discharge channel 37 becomes smaller.

According to the above description, a die for forming the inner surface 32 of the inlet tube 31 can be removed from the suction port 34 and a die for forming the discharge channel 37 can be removed from the discharge port 33. It should be understood that in other embodiments, when the inner diameter of the suction channel 32 remains constant and the shape thereof is still arc-shape, or the suction channel 32 extends in a linear way and the inner diameter thereof becomes smaller as it approaches the suction passage 27, the die for forming the inlet channel 32 can be removed from the suction port 34.

Referring to FIGS. 2 and 4, the sealing plate 40 is circular, with a hole 42 formed at the center. The sealing plate 40 is fixed in the first opening 24*a* of the recess 24 on the first surface 22 so as to seal the first opening 24*a*. A shaft 62 of the motor 60 penetrates a bearing 64 that is fixed in the hole 42. A seal (not shown) prevents water from leaking out of the pump chamber via the bearing/shaft interface. The impeller 50 is accommodated in the pump chamber formed by the recess 24 and the sealing plate 40 and is connected to the shaft 62. The impeller 50 includes a first cover 52, a number of vanes 54 extending from the first cover 52, and a second cover 56 connected to the vanes 54. The second cover 56 includes an opening forming the inlet 58 of the impeller. The suction passage 27 is axially aligned with the inlet 58, so that water can flow into the impeller. The outer diameter of the second cover 56 becomes smaller along a direction away from the first cover 52. The distance between the outer surface of the second cover 56 and the wall 26 of the recess 24 remains substantially the same.

In operation, the impeller 50 is driven by the motor 60. Water flowing into the impeller 50 is expelled by the vanes through the exits (not labeled) defined by the first cover 52, the second cover 56, and adjacent vanes 54, under centrifugal force. Water passing through the impeller 50 flows to the wall 26 of the recess 24, and under the leading of the discharge groove 28, the water flows in a spiral manner to the discharge port 33, as shown by the dashed line in FIG. 3.

As the dies for producing the recess 24 and suction passage 27, the suction channel 32, and the discharge channel 37 can all be removed from the pump casing 20 without damage when the pump casing 20 has been formed, the whole pump casing 20 can therefore be made by a single plastic injection molding process, thereby the efficiency of manufacturing the pump casing is improved.

Preferably, the inner surface of the suction channel 32 includes a top arc wall 32*a* and a bottom arc wall 32*b*, as shown in FIG. 4, which is a sectional view taken along a plane IV-IV of FIG. 1 and defined by the axis of the motor and a radial direction of the motor on which the center line 39 of the suction channel 32 projects. The curvature of the top arc wall 32*a* is between 0.006 and 0.01 $mm^{-1}$, and the included angle $\alpha$ between the tangent direction of the end of the top arc wall 32*a* of the suction channel 32 at the suction port 34 and the direction perpendicular to the axis of the motor (horizontal direction) is between 5 and 12 degrees. The curvature of the bottom arc wall 32*b* is between 0.006 and 0.0085 $mm^{-1}$, and the included angle $\beta$ between the tangent direction of the end of the bottom arc wall 32*b* of the suction channel 32 at the suction port 34 and the horizontal direction is between 5 and 12 degrees. Preferably, the curvature of the top arc wall 32*a* is about 0.0071 $mm^{-1}$, and the included angle $\alpha$ is about 5 degrees; the curvature of the bottom arc wall 32*b* is about 0.0070 $mm^{-1}$, and the included angle $\beta$ is about 8 degrees. In this way, the axial height of the whole pump casing 20 is reduced.

Figure 5:
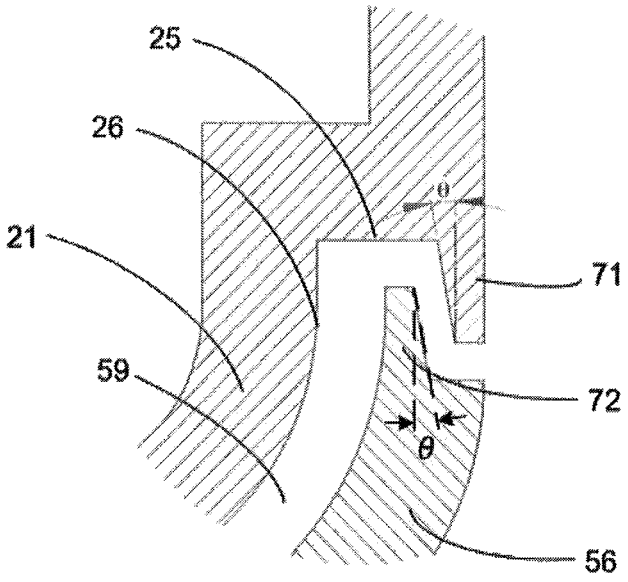
FIG. 5 is an enlarged view of the box VI in FIG. 4.

Preferably, as shown in FIG. 5, the main body 21 further includes a first ring 71 projecting from the second surface 25 and surrounding the second opening 27*a* of the recess 24. The second cover 56 further includes a second ring 72 at its axial end surface that is substantially perpendicular to the axis of the motor, surrounding the inlet 58. The first ring 71 and the second ring 72 are spaced from each other in the radial direction of the motor, and at least partially overlap with each other in the axial direction of the motor. As such, the second ring 72 surrounds the first ring 71 and faces the first ring across a radial air gap. In this way, water is fully ducted into the inlet 58 of the impeller 50.

Referring to FIG. 4, during operation, part of the water thrown out of the impeller 50 may flow back to the inlet 58 of the impeller 50 via the space 59 between the outer surface of the second cover 56 and the wall 26 of the recess 24. This will lower the efficiency of the pump. Thus, preferably, referring to FIG. 5, the radially inner surface of the second ring 72 is inclined at an angle $\theta$ towards the axial direction of the impeller. The radially outer surface of the first ring 71 is parallel with the radially inner surface of the second ring 72. This structure eases the water at the inlet of the impeller 50 to flow into the space 59 after impact on the impeller 50, the main body 21, or itself. This part of water forming a resistance against that tends to running back to the impeller 50 via the space 59, and thus the efficiency of the pump is improved. Preferably, $10° \leq \theta \leq 20°$.

Figure 6:
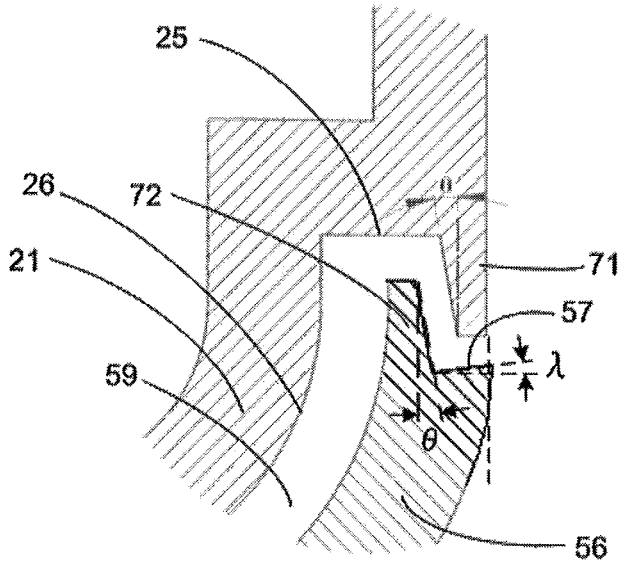
FIG. 6 is a view similar to FIG. 5, of a variation in accordance with another embodiment of the present invention.
Figure 7:
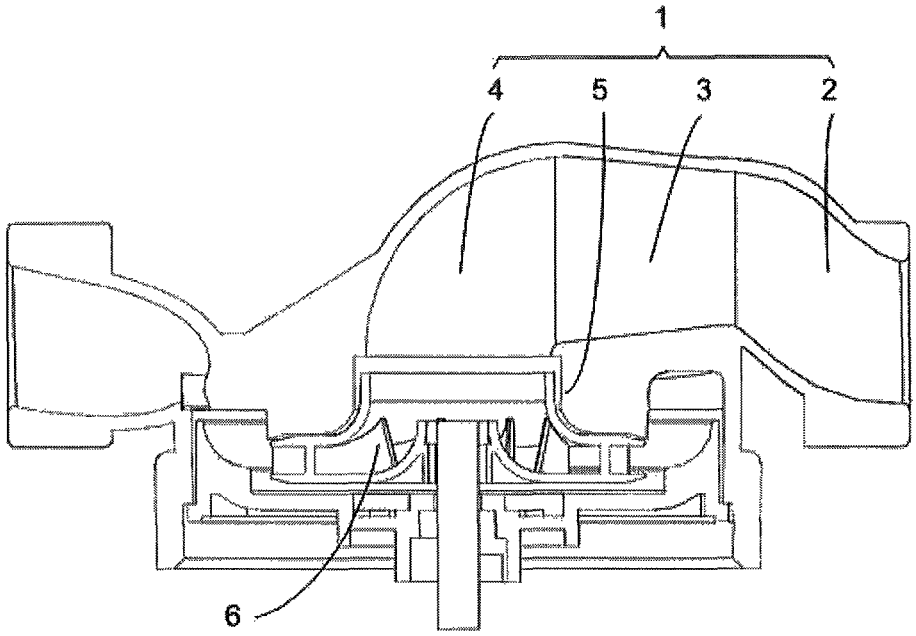
FIG. 7 PRIOR ART
FIG. 7 is a sectional view of a prior art pump.

Preferably, referring to FIG. 6, compared to the radially inner end of the first ring 71 (shown by the axial dashed line), the radially inner end of the second cover 56 extends closer to the axis of the impeller 50 (or motor 60 as the motor and impeller are coaxially aligned). As such, when the water flows into the inlet 58 of the impeller 50, part of the water close to the radially inner end of the second cover 56 will be intercepted by the end surface 57 of second cover 56, which contributes to the quantity of water flowing into the space 59 and thus helps to improve the efficiency of the pump.

Preferably, as shown in FIG. 6, the end surface 57 of the second cover 56 from which the second ring 72 projects, in inclined at an angle $\lambda$ to the direction perpendicular to the axial direction of the motor with the radially inner edge of the end surface 57 displaced towards the suction passage 27. In this way, water entering the impeller can flow into the space 59 more easily. Preferably, $5° \leq \lambda \leq 40°$.

Preferably, referring to FIG. 1, the main body 21 further includes a number of ribs 29 on the second side surface 23, extending substantially in radial directions of the motor to enhance the strength of the main body 21.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A pump comprising:

a pump casing;

a pump chamber formed in the pump casing;

an impeller disposed within the pump chamber, the impeller having a plurality of vanes forming an inlet and an outlet;

a sealing plate, forming one side of the pump chamber;

a motor for driving the impeller;

wherein the pump casing is a monolithic object comprising:

a main body having a first surface, a recess in the first surface, a suction port, a suction channel, a suction passage, a discharge port, and a discharge channel, wherein the recess forms a first opening in the first surface, the first opening is closed by the sealing plate to form the pump chamber, the recess having a second opening in a second surface opposite the first surface and a wall connecting the first surface to the second surface;

the suction passage communicates with the recess via the second opening and is aligned with the inlet of the impeller;

the suction port is connected to the suction passage by the suction channel;

the discharge port is connected to the recess by the discharge channel which extends from a third opening formed in the wall of the recess;

the diameter of wall of the recess remains the same or decreases along a direction from the first surface to the second surface;

the diameter of the inner surface of the suction passage remains the same or decreases along a direction away from the recess;

the inner diameter of the suction channel remains the same or decreases along a direction towards the suction passage; and the inner diameter of the discharge channel remains the same or decreases along a direction towards the recess;

wherein the main body further comprises a first ring projecting into the recess from the second opening, and the impeller further comprises a ring-shaped end surface surrounding the inlet and a second ring projecting from the end surface and surrounding the first ring, the second ring faces the first ring across a radial gap, the radially inner end of the end surface of the impeller extends closer to the axis of the impeller, compared to the radially inner end of the first ring.

2. The pump of claim 1, wherein the suction channel comprises an inner surface having a top arc wall and a bottom arc wall that is closer to the recess than the top arc wall, the curvature of the top arc wall is between 0.006 and 0.01 $mm^{-1}$, the curvature of the bottom arc wall is between 0.006 and 0.0085 $mm^{-1}$, and an included angle $\alpha$ between the tangent direction of the end of the top arc wall at the suction port and a direction in which the first surface extends and an included angle β between the tangent direction of the end of the bottom arc wall at the suction port and a direction in which the first surface extends are both between 5 and 12 degrees.

3. The pump of claim 2, wherein the curvature of the top arc wall is 0.0071 $mm^{-1}$; the included angle α is 5 degrees; the curvature of the bottom arc wall is 0.0070 $mm^{-1}$, and the included angle β is 8 degrees.

4. The pump of claim 1, wherein the main body further comprises a spiral discharge groove in the boundary of the recess and extending from the second opening to the third opening.

5. The pump of claim 1, wherein the main body further comprises a number of ribs extending from the center to the peripheral thereof.

6. The pump of claim 1, wherein a radially inner surface of the second ring is inclined at an angle θ, with respect to the axial direction of the impeller.

7. The pump of claim 6, wherein $10° \leq \theta \leq 20°$.

8. The pump of claim 1, wherein the end surface is inclined at an angle λ to a radial plane, such that the inner edge of the end surface is displaced towards the suction passage.

9. The pump of claim 8, wherein $5° \leq \lambda \leq 40°$.

10. The pump of claim 1, wherein the pump casing is a single piece plastic injection molding.

* * * * *